US007538688B1

(12) United States Patent
Stewart

(10) Patent No.: US 7,538,688 B1
(45) Date of Patent: May 26, 2009

(54) PORTABLE AREA SAFETY ZONING SYSTEM

(76) Inventor: Robin Hardie Stewart, 3403 Brightwood La., Apartment 9, Woodbridge, VA (US) 22193

( * ) Notice: Subject to any disclaimer, the term of this patent is extended or adjusted under 35 U.S.C. 154(b) by 371 days.

(21) Appl. No.: 11/508,255

(22) Filed: Aug. 23, 2006

(51) Int. Cl.
*G08G 1/095* (2006.01)

(52) U.S. Cl. ..... 340/908; 116/63 C; 340/540; 340/541; 340/539.22; 340/669; 340/693.5; 340/908.1; 340/954; 348/149; 404/6

(58) Field of Classification Search ..... 340/908, 340/908.1, 933, 936, 937, 953, 954, 947, 340/540, 541, 669, 691.1, 691.7, 692, 331, 340/539.1, 539.16, 539, 17, 539.22, 815.4, 340/693.5; 348/148, 149, 152, 153, 158, 348/159; 404/6, 9; 116/63 C
See application file for complete search history.

(56) References Cited

U.S. PATENT DOCUMENTS

| | | | | |
|---|---|---|---|---|
| 3,519,984 | A | 7/1970 | Zychal | |
| 4,515,499 | A | 5/1985 | Furiate | |
| 4,573,109 | A | 2/1986 | Lack | |
| 4,770,495 | A | 9/1988 | Lees | |
| 4,862,164 | A | 8/1989 | Croley et al. | |
| 5,030,029 | A | 7/1991 | Johnsen | |
| 5,115,343 | A | 5/1992 | Bennett | |
| 5,350,330 | A | 9/1994 | Platis | |
| 5,501,429 | A | 3/1996 | Sakuma | |
| 5,529,429 | A | 6/1996 | Pelegrin | |
| 5,597,262 | A | 1/1997 | Beavers et al. | |
| 5,722,611 | A | 3/1998 | Schmid et al. | |
| 5,722,788 | A | 3/1998 | Bent et al. | |
| 6,053,657 | A | 4/2000 | Signorelli | |
| 6,069,557 | A | 5/2000 | Anglin, Jr. et al. | |
| 6,142,701 | A | 11/2000 | Falcon | |
| 6,174,070 | B1 | 1/2001 | Takamura et al. | |
| 6,193,190 | B1 | 2/2001 | Nance | |
| 6,215,416 | B1 | 4/2001 | Henderson | |
| 6,288,651 | B1 * | 9/2001 | Souza | 340/908.1 |
| 6,338,311 | B1 | 1/2002 | Ho | |
| 6,386,135 | B1 | 5/2002 | Oshima | |
| 6,509,844 | B1 | 1/2003 | Eyring | |
| 6,512,451 | B1 * | 1/2003 | Eslambolchi et al. | 340/908.1 |
| 6,556,147 | B1 | 4/2003 | Fisher et al. | |
| 6,558,068 | B1 | 5/2003 | Wittig | |
| 6,559,774 | B2 | 5/2003 | Bergan et al. | |
| 6,753,762 | B1 * | 6/2004 | Jorba Gonzalez | 340/908.1 |
| 6,754,974 | B2 | 6/2004 | Bassolino et al. | |
| 6,971,329 | B1 * | 12/2005 | Stewart | 116/63 C |
| 7,030,777 | B1 * | 4/2006 | Nelson et al. | 340/908.1 |
| 7,230,546 | B1 * | 6/2007 | Nelson et al. | 340/908.1 |
| 2002/0067290 | A1 * | 6/2002 | Peet et al. | 340/908 |
| 2003/0107493 | A1 * | 6/2003 | Recko et al. | 340/692 |

(Continued)

*Primary Examiner*—Thomas J Mullen
(74) *Attorney, Agent, or Firm*—Lawrence R. Franklin

(57) ABSTRACT

Temporary safety zones are established by deploying a plurality of safety icons connected by extensible, brightly colored, retro-reflective tapes. The tapes are retracted within the housings of the safety icons. A plurality of modules having different functions are removably affixed to the base of the safety icons, the modules including sensors, beacons, transceivers, detection devices, and audio receivers and video cameras. Because the modules are manually interchangeable, the safety zones can be implemented for specific, interchangeable circumstances, e.g., a surveillance station, portable helipad, landing strip, and restricted area barriers.

20 Claims, 7 Drawing Sheets

U.S. PATENT DOCUMENTS

2004/0021580 A1* 2/2004 Higgs ..... 340/908
2004/0060499 A1* 4/2004 Penque, Jr. ..... 116/63 P
2006/0055559 A1* 3/2006 Leonard ..... 340/908.1
2007/0222640 A1* 9/2007 Guelzow et al. ..... 340/908

* cited by examiner

PORTABLE AREA SAFETY ZONING SYSTEM

CROSS-REFERENCES TO RELATED APPLICATIONS

Not Applicable.

STATEMENT REGARDING FEDERALLY SPONSORED RESEARCH OR DEVELOPMENT

Not Applicable.

THE NAMES OF PARTIES TO A JOINT RESEARCH AGREEMENT

Not Applicable.

REFERENCE TO A "SEQUENCE LISTING"

Not Applicable.

BACKGROUND OF THE INVENTION (1) Field of the Invention

This invention relates to a safety icon and a combination integrating the safety icon and other technological elements into a Portable Area Safety Zoning system (PASZ) to create a variety of safe zones for military, police, and civilian uses.

(2) Description of Related Art Including Information Disclosed Under 37 CFR 1.97 and 1.98

Icons, i.e., entities whose form suggests its meaning, have been used for centuries. In today's computer age, most people associate icons with pictures, mainly the graphic symbols on a computer display screen that suggests the associated function, e.g., a pictorial depiction of a trash can for disposing of files. The concept of an icon, however, also includes objects, e.g., the Statue of Liberty, the Great Wall of China, and Mount Rushmore. For the purpose of this invention, a safety icon is an object which is instantly recognizable as a device which promotes safety. The focus of this invention comprises safety icons which set apart one area from another, usually a secured zone from an unrestricted zone for pedestrian, automobile, or aircraft traffic. The sample icon in the description of the invention comprises a variation of a traffic safety cone, but the scope of the invention disclosed and claimed is not limited to the specific physical form of the cone disclosed.

Traffic safety icons have come in many recognizable forms, including posts (U.S. Pat. No. 4,573,109), barrels (U.S. Pat. No. 5,722,788), pylons (U.S. Pat. No. 5,115,343), cones (U.S. Pat. No. 6,558,068), and signalling devices uniquely designed for a particular purpose (U.S. Pat. No. 6,174,070). (The patents listed in parentheses are representative of the types of safety icons mentioned; see the patents cited of record for a more comprehensive list.) By and large, each of them have limited usages and permit of only minor variations.

The manner of using the safety icons includes those which may stand alone (U.S. Pat. Nos. 5,597,262, 5,722,788, 6,556,147, and 5,529,429) or are permanently joined together (U.S. Pat. No. 4,515,499). Most safety icons, however, are temporarily attached to an adjacent icon by solid or flexible barriers (U.S. Pat. Nos. 5,501,429, 5,030,029, 6,053,657, and 6,386,135). The icons of interest in this category are portable and typically arranged to delineate an open or closed perimeter (U.S. Pat. Nos. 4,770,495, 5,501,429, 5,030,029, and 7,030,777). Those that are permanently connected to each other are difficult to store and transport, and those temporarily attached to an adjacent icon, again, lack sufficient versatility to justify being carried by military or civilian units having limited space and/or weight restrictions.

Of particular relevance to the disclosed invention are systems which utilize portable safety icons to control or monitor traffic (U.S. Pat. Nos. 4,515,499, 5,501,429, 6,559,774, and 7,030,777), to set up temporary landing sites for helicopters or airplanes (U.S. Pat. Nos. 4,862,164, 6,069,557, 6,174,070, 6,193,190, and 6,509,844), and to cordon off selected areas (U.S. Pat. No. 4,770,495). While all of these are suitable and effective for the functions for which they were designed, a study of their structures and operational requirements will make it immediately apparent that cross-over from one use to another is quite impractical if not impossible.

BRIEF SUMMARY OF THE INVENTION

The present invention overcomes the difficulties described above by integrating a plurality of safety icons with a variety of special-function modules to create a system of establishing a concomitant variety of safety zones having universal applicability under a variety of situations. A carrying case houses a set of safety icons. Each safety icon is collapsible so that it is compact for storage and travel and is extendable to provide a relatively large body which is sufficient to achieve its goals of being easily seen from land and air. The base of each safety icon includes a retractable, retro-reflective tape and anchor tabs for latching to retractable tapes of adjacent icons. The base of each safety icon is adapted to receive a plurality of modules. Each module is designed to be manually connected and removed from said base while being stably attached when connected. A variety of modules are provided, each of which are designed to perform a specific function. One type of module acts as a beacon guiding personnel to the icon, e.g., as with a light beam (LED, infrared, ultraviolet, halogen, etc.), a radio beam, or a GPS signalling beam. Other types of modules include sensors comprising video cameras, motion sensors, light sensors, explosive detection devices, etc., as will be described in more detail anon. The modules are small, compact, and are self-contained. A large variety of modules can be easily stored and transported, even under conditions where space is a premium. Assembly, deployment, and the dismantling of icons and modules is easily performed by relatively unskilled personnel. The PASZ system provides equal or increased safety as compared to prior systems, while adding needed versatility in functions allowing it to adapt to changing environments and needs. PASZ is an inexpensive system which provides military, police, fire and rescue, security, and other similar personnel, with affordable means to do their job safely and effectively.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE INVENTION

Figure 1:
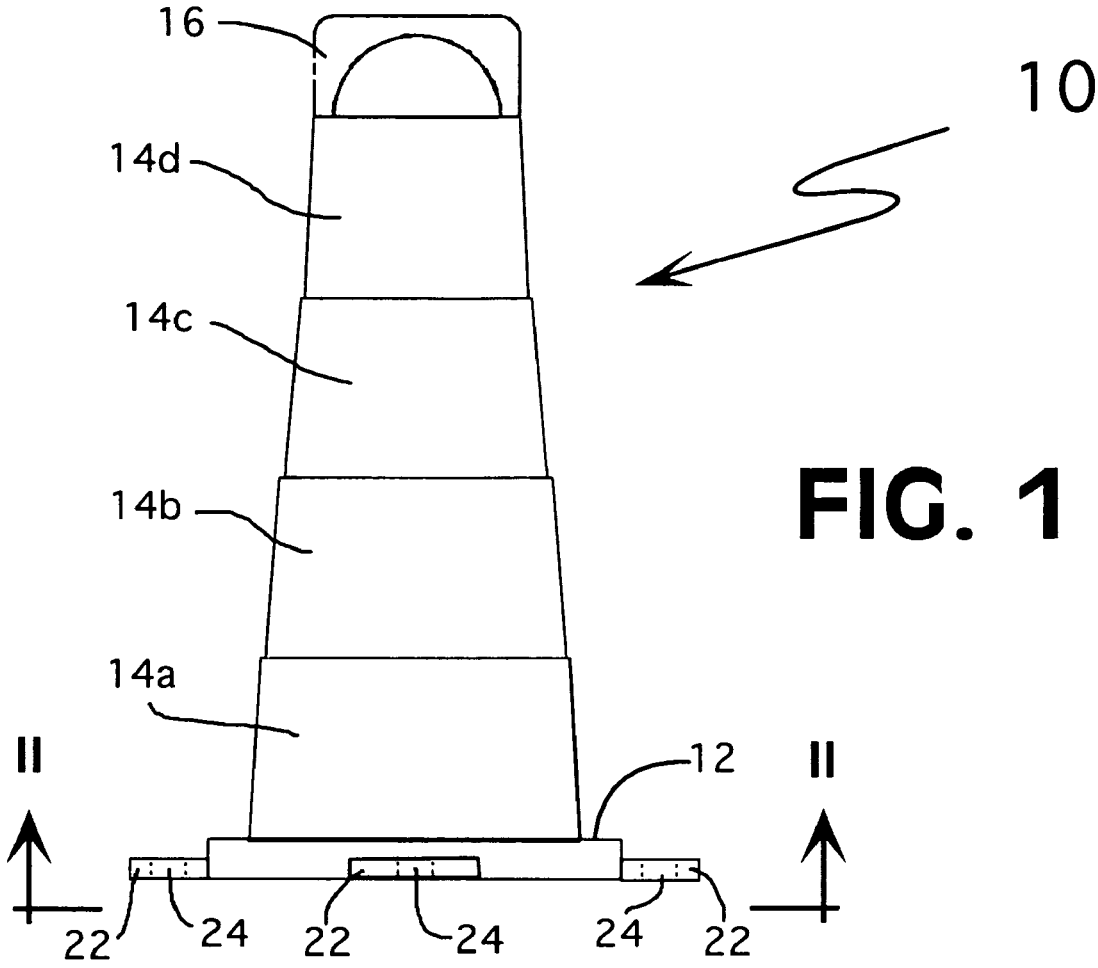
FIG. 1 is a back view of a preferred embodiment of a collapsible safety cone.

A safety cone 10 is shown in FIG. 1. Safety cone 10 comprises a basic element of the Portable Area Safety Zoning System (PASZ), a few representative applications of which are disclosed in FIGS. 8-12, below. Safety cone 10 comprises a base 12, and a plurality of collapsible cone segments 14*a*-14*d*, the uppermost of which has a cone handle 16 integral therewith.

Figure 2:
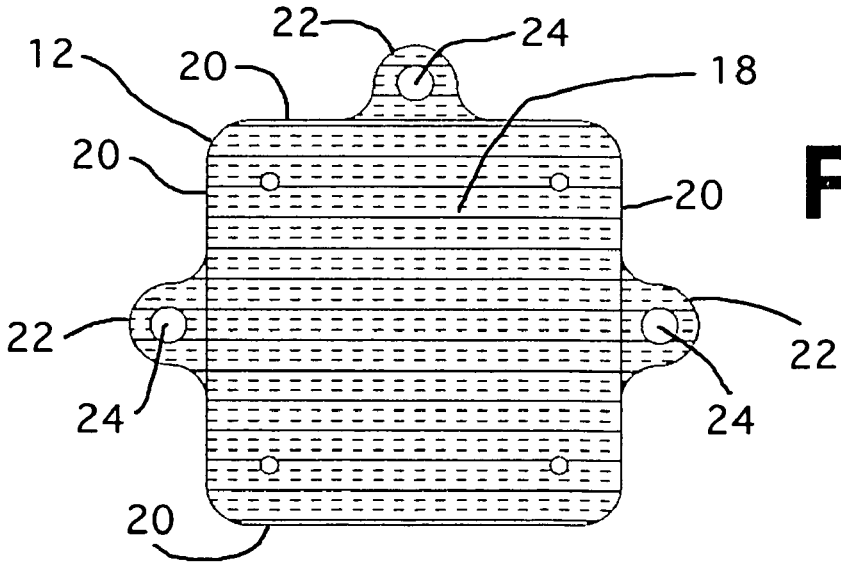
FIG. 2 is a bottom view of the safety cone of FIG. 1 as seen along lines II-II in FIG. 1.

Base 12 is weighted to lower its center of gravity for stability, and the bottom 18 of base 12 (FIG. 2) is preferably textured and/or covered with a non-slip material to assist in maintaining its position after placement. In the preferred embodiment, base 12 is square with four sides 20; other peripheral shapes, e.g., circular, triangular, octagonal, etc., are contemplated, however. Integral with and protruding from each of three sides 20 of base 12 is an anchor tab 22 which includes a vertically extending aperture 24.

Figure 3:
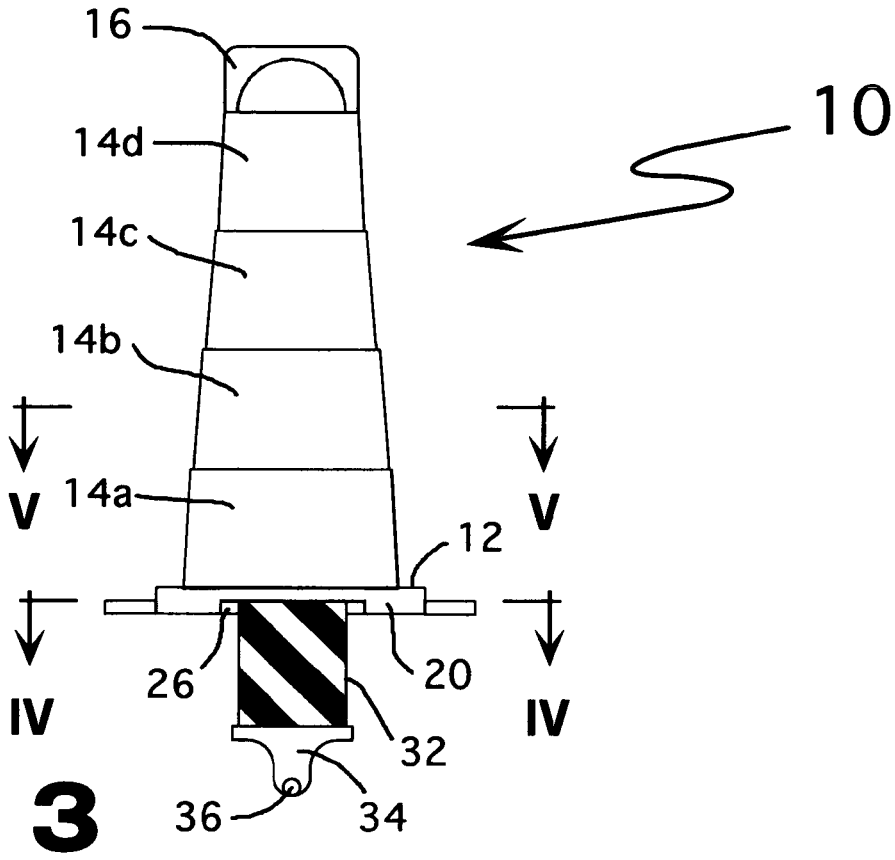
FIG. 3 is a front view of the safety cone of FIG. 1.
Figure 4:
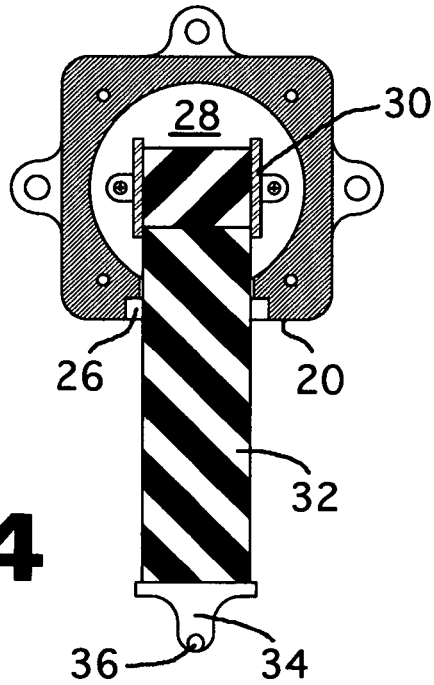
FIG. 4 is a top sectional view of the safety cone of FIG. 1 as seen along lines IV-IV in FIG. 3.

Referring to FIGS. 3-4, a front view and a top sectional view taken along lines IV-IV of FIG. 3, respectively, of safety cone 10 is shown. The fourth side 20 of base 12 has a slot 26 extending from the outer edge into the hollow interior 28 (FIG. 4) of safety cone 10. Mounted within hollow interior 28 is a retracting mechanism 30 for a retro-reflective, retractable tape 32. (A retro-reflective surface is one which reflects incident light back in the direction from which it came, as opposed to scattering it or reflecting it in the direction away from the source, as in a mirror.) By locating retracting mechanism 30 centrally within base 12, the center of gravity of cone 10 is further lowered and centralized, thereby increasing the stability of cone 10. Slot 26 is stepped, having an enlarged portion leading into a narrower portion; see FIG. 4. The flexibility of tape 32 plus the funnel-like shape of slot 26 allows tape 32 to exit slot 26 at various angles, generally within a 50° to 60° angle. Fixed to the free end of tape 32 is a hitch 34, preferably comprising a pin 36 adapted to be latched securely within an aperture 24 of one of the anchor tabs 22 of an adjacent safety cone 10, as will become apparent shortly. In the drawings, tape 32 is shown as extending a short distance outside of base 12; this is for illustration only. In practice, when pin 36 is not engaged with an aperture 24, retracting mechanism 30 biases hitch 34 of tape 32 into the enlarged portion of slot 26 (FIG. 4) for safety and compactness during storage and transportation thereof.

Figure 5:
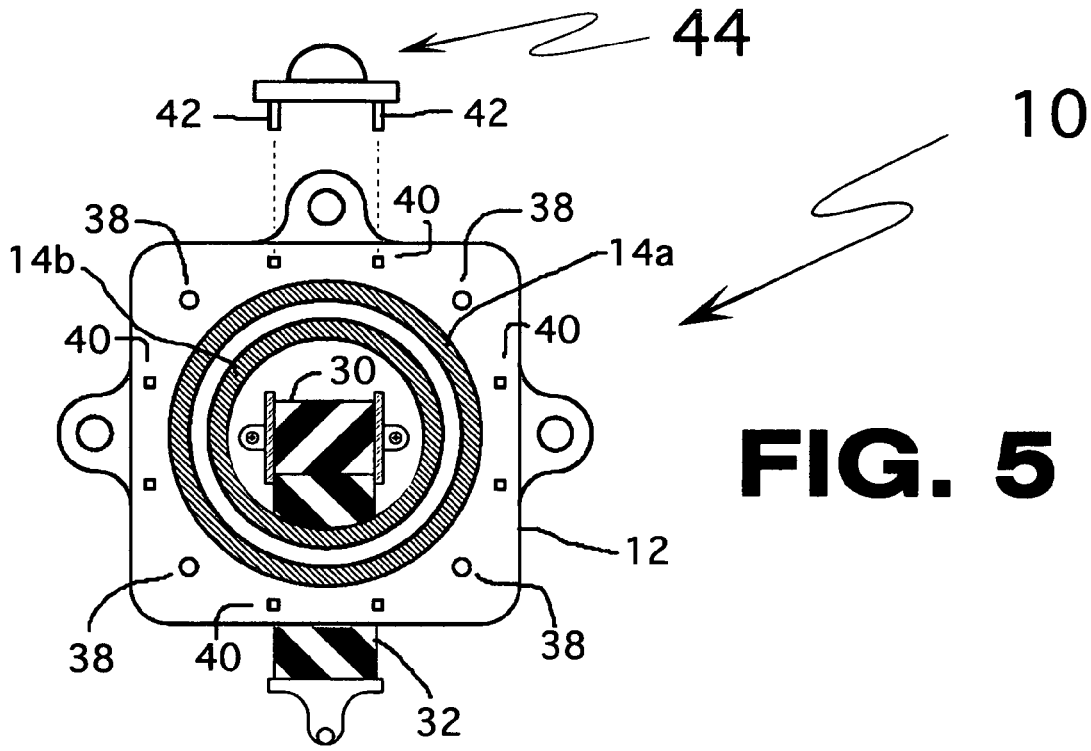
FIG. 5 is a top sectional view of the safety cone of FIG. 1 as seen along lines V-V in FIG. 3.

FIG. 5 is a top view of safety cone 10 as seen along lines V-V of FIG. 3 where the first two cone segments 14*a* and 14*b* are shown in section. Retracting mechanism 30 and tape 32 are as before. Base 12 includes a through opening 38 spaced inwardly from each corner. Corner openings 38 are suitably sized to receive anchoring stakes (not shown) when it is necessary to securely fix safety cone 10 to a surface.

Also included in base 12 are pairs of apertures 40, each of which are located approximately midway of sides 20 and the lowermost cone segment 14*a*. Aperture pairs 40 comprise mounts which are adapted to receive a corresponding pair of pins 42 depending from any one of a plurality of modules 44, the types and applications of which are to be described relative to FIGS. 8-12. Mounts 40 and pins 42 removably fix modules 44 to base 12 and can comprise apertures with slightly resilient walls into which pins are friction fit, threaded apertures and mating bolts, or smooth bores and selectively expandable shafts. A resilient friction fit is usually sufficient, as there are no external forces trying to separate modules 44 from base 12, except when being manually removed. A resilient friction fit is preferred as well, as it allows for quick and easy attachment, withdrawal, and/or replacement of modules 44. Up to four different kinds of modules can be accommodated by the four mounts 40 included in each cone, providing important versatility to the inventive concepts disclosed herein.

Figure 6:
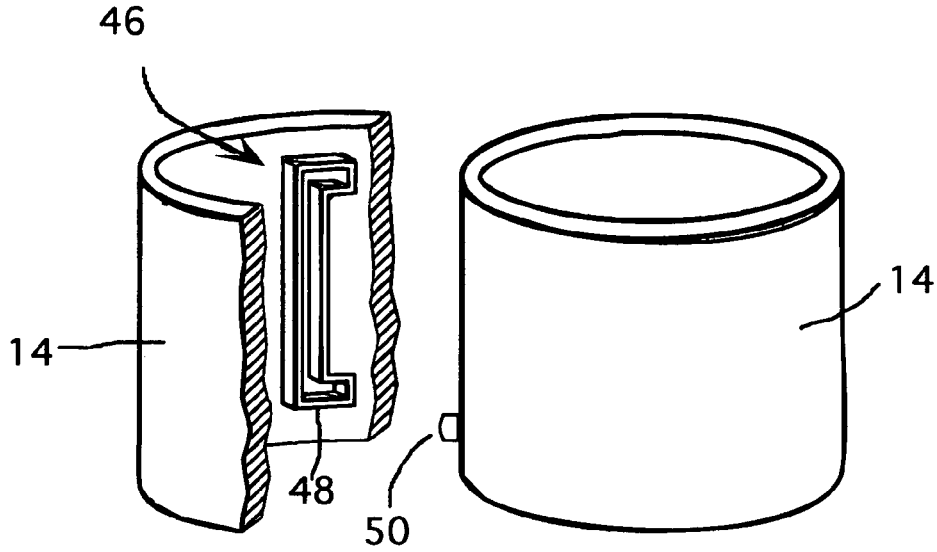
FIG. 6 is a schematic depiction of the locking mechanism of the collapsible safety cone of FIG. 1.

Collapsible cone segments 14 are locked in either of two states, an upper, extended state and a lower, storage state. Any known locking mechanism can be used, but the locking mechanism 46, shown in FIG. 6, is preferred. Locking mechanism 46 comprises a C-shaped slot 48 on the internal wall of the lower of the two cone segments 14 which cooperates with a fixed external locking pin 50 on the upper of the two cone segments 14. When in the collapsed state with pins 50 at the blind end of the lower arms of C-shaped slots 48, grasping handle 16 and rotating it counter-clockwise will move each locking pin 50 along the lower arm of its associated C-shaped slot 48 until all locking pins 50 are in register with the vertical bights of C-shaped slots 48. To completely extend cone 10, just pull upwardly until all locking pins 50 reaches the top of their vertical bights and rotate clockwise to move locking pins 50 outwardly to the extremities of the upper arms of C-shaped slots 48. In this manner, all of cone segments 14*a*-14*d* are simultaneously unlocked, extended, and locked by a simple twist, pull, twist motion which is easily effected by only one hand. Reverse the movements to collapse safety cone 10. Mechanism 46 promotes quick and easy deployment of safety cones 10, a desiderata infused throughout the design and use of the PASZ cones.

Figure 7:
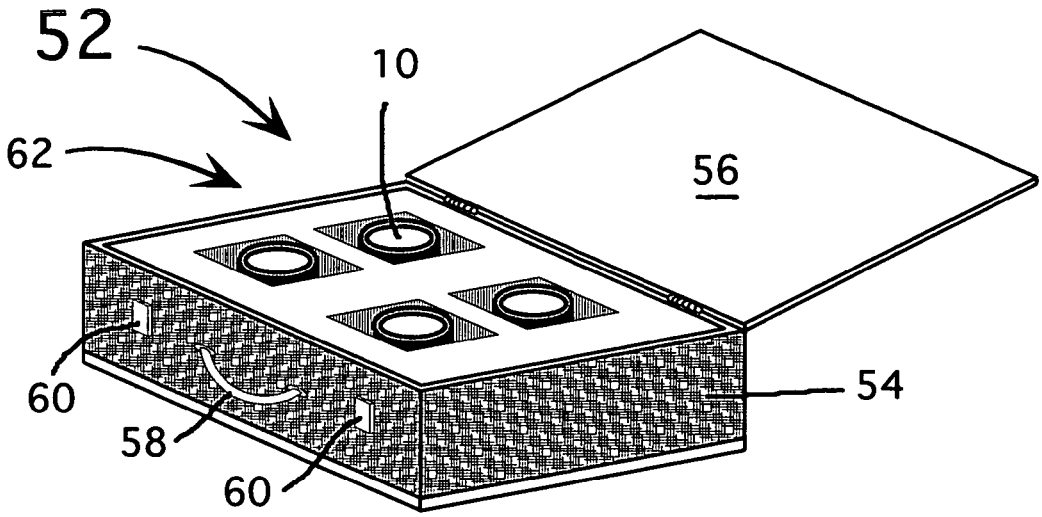
FIG. 7 shows a carrying case for four of the collapsible safety cones of FIG. 1.

Safety cones 10 are designed to be used in the field to clearly and distinctly delineate safety zones. As such, they must be both of sufficient number to accomplish the goals and portable enough to be effectively deployed quickly and easily. A suitcase 52 (FIG. 7) comprising a main body 54, a lid 56, a handle 58 and a pair of latches 60 houses a set 62 of four safety cones 10. Sets of four safety cones, or multiples of four, have been found to be optimum for creating most perimeters of desired safety zones. Suitcase 52 provides storage for discrete sets of safely cones and facilitates transport thereof to the desired location of the safety zone. Temporary safety zones, also referred to herein as PASZ stations, are useful in a multitude of civilian and military situations. A few exemplary ones are shown in FIGS. 8-12.

The military applications of PASZ are many. One of the most important is the surveillance of passing vehicles.

It is well known that our military personnel are subject daily to suicide bombers in vehicles rigged with explosives, a scenario likely to be repeated for decades to come. Early detection of them is crucial, but a hands-on inspection can be dangerous, since should the bomber suspect he has been discovered, he might intentionally detonate the explosives, putting anyone nearby at risk. Also, a surveillance zone must be established well removed from potential targets in order to further protect personnel, supplies, and equipment. The surveillance zone should be effective in identifying potential enemies while simultaneously providing safety for our troops. Such a safety zone comprising a PASZ station utilizing PASZ equipment and concepts can be achieved quickly and easily.

Figure 8:
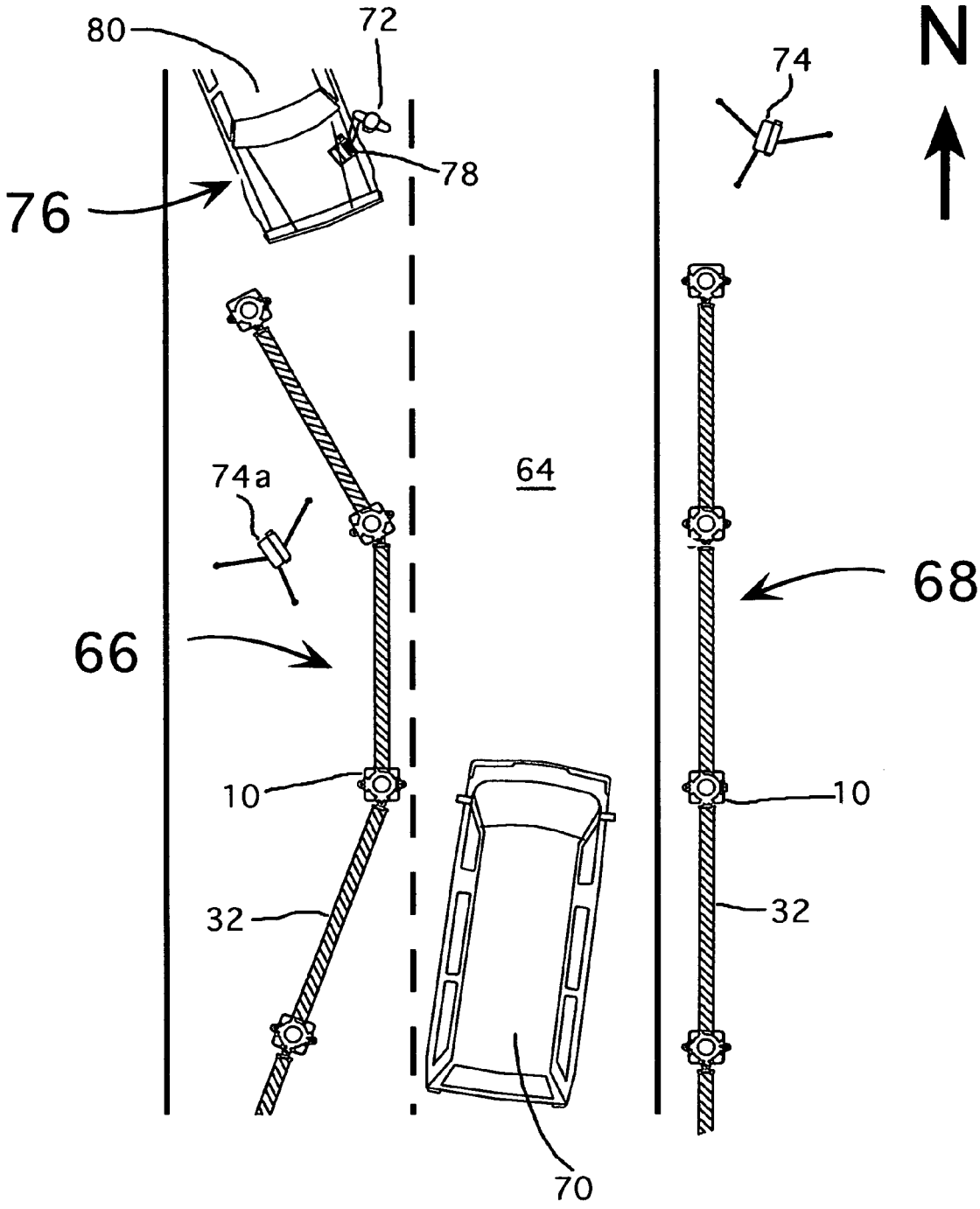
FIG. 8 depicts a surveillance check-point utilizing the safety cones of FIGS. 1-6.

Exemplary is the showing in FIG. 8, wherein two lanes of a highway 64, both for Northbound traffic (bottom to top in the drawing), are shown. A surveillance zone is established by two sets 66 and 68 of safety cones 10 interconnected by retro-reflective, retractable tapes 32. Set 66 defines a merge-directing fence, and set 68, placed alongside the roadway, establishes a boundary restricting passage of vehicle 70 to a narrow slot shown as comprising a single lane of highway 64. Vehicle 70 is slowed and directed by sets 66 and 68 into the open lane to facilitate inspection thereof.

A plurality of modules 44 (FIG. 5) are mounted on the base 12 of each cone 10. Each module is designed for a specific purpose and is self-contained. That is, each comprises a detector suitable for the function needed at the specific PASZ station and a transceiver for receiving control signals, where appropriate, and for sending images, data, and/or other information to surveillance personnel 72.

In a vehicle surveillance system, as in FIG. 8, each cone 10 has a module 44 comprising a video camera module facing the roadway. Being mounted on the base 12 of cones 10, virtually at ground level, the cameras are capable of inspecting the bottom of vehicle 70 for any signs of unusual modifications, such as anything which is indicative of the presence of explosives. Also mounted on each base 12 are modules 44 comprising explosive "sniffers," devices capable of detecting minute amounts of gaseous emanations from various types of explosives. Other types of chemical or other particle detector modules suitable for sensing materials commonly used in chemical warfare weapons could be attached to cones 10 where indicated. Radiation sensing modules 44 can also be mounted on cones 10, should it be suspected the vehicle is transporting radioactive materials. And, motion sensor modules to detect the presence of a moving body and accelerometers for detecting collisions with the cones also find applicability in PASZ surveillance stations. This list of types of modules 44 is not exhaustive. Others can easily be designed for detecting or observing other specific parameters of interest and find utility as removable modules on safety cones 10 in a PASZ system.

A portable, remote controlled video camera 74 is preferably included near the PASZ station to permit a close look at the type, color, and make of vehicle 70, its license plate, and the driver and passengers. Video camera 74 can be positioned at an optimum location for an early look at the occupants of vehicle 70. Camouflaging video camera 74 or otherwise hiding it from view permits observing said occupants without arousing their suspicions. Additional video cameras 74 can be strategically placed in order to coordinate with each other in inspecting larger vehicles (tanks, trucks, vans, SUVs, etc.) in more detail. One such optional video camera 74*a* is shown behind set 66 of safety cones 10. An interrogation system comprising speakers and microphones are preferably included with video camera 74*a*. An automatic voice language translation device is also preferably included with video camera 74*a*, in order to automatically translate the driver's language into English. All video camera systems are equipped with remote control capability to allow for their operations from a safe distance.

All images, data, and other information are immediately transmitted in real time to a central control station 76, preferably a portable computer 78 in operable contact with a control vehicle 80. Preferably, communication between modules 44 and control station 76 is by wireless transmission. When jamming or interception of signals is possible, hard-wiring the components is within the PASZ system's operating parameters. For instance, all modules which transmit or receive signals have input and output ports for receiving cables connecting them to other modules and/or to central control 76, permitting hard-wiring of all appropriate components. Control vehicle 80 is suitably equipped with a sophisticated computer having software which synthesizes and analyzes the data using linked programs, including face recognition databases, language translation databases, vehicle information databases, etc., and forwards its results to computer 78 for human interpretation. Upon reviewing the incoming data, surveillance personnel 72 direct the actions of local forces whose response is immediate.

Control point 76 is shown adjacent safety cone set 66 for convenience in drawing only; in a real environment, control vehicle 80 and its operating personnel would be as far removed from the area as is practicable. Thus, the entire surveillance is effected without endangering anyone at all.

Multiple modules of the same type increase the capabilities of the PASZ surveillance system. For example, all images from video modules 44 can be merged by software in control vehicle 80 for viewing in computer 78 to provide an extended, seamless picture of the underside of the car, as if an observer were beneath the car travelling along with it, inspecting its underside. In like manner, the detected gasses from sniffer modules 44 can be added together to give a cumulative reading which is more sensitive than one module acting alone would be. If the single lane were extended for a great distance, e.g., a mile or so, a comparison of the signals from motion detector modules 44 would pinpoint the location and speed of the vehicle passing through. Accelerometer modules 44 would immediately detect any collision with a safety cone 10 indicating an excursion from the delineated single lane, should the driver of vehicle 70 panic, try to escape, or change targets to include the surveillance personnel 72. Deviations from the restricted lane of travel would sound an alarm, thereby giving advanced warning of suspicious activities of a subject vehicle.

Computer 78 provides an immediate evaluation of the incoming data by personnel 72 on the scene. It is an important part of the PASZ surveillance system, however, that all data be relayed via satellite to a home base (not shown) to be evaluated in more detail by highly trained computer specialists equipped with larger, faster, and more sophisticated computers. For example, the facial images transmitted by video camera 74 could be analyzed by facial recognition software in a larger database in a larger computer at the home base. The home base could be located miles away, for example, at the general headquarters of the command. It would comprise an intelligence center capable of receiving, processing, and integrating data from a plurality of PASZ stations. The coordination of the efforts of the entire command is clearly enhanced by the capabilities of the portable PASZ systems.

When viewed from a distance, a set of safety cones, such as sets 66 and 68, are seen along the line of cones, so they appear as a substantially solid wall. When viewed in passing, however, if all that connects adjacent cones are imaginary lines which exist only in the minds of the viewers, the safety boundary can easily be visually lost. Retro-reflective, retractable tape 32 obviates the problem by providing an easily seen, physical connection between cones 10. Since the driver of vehicle 70 is assumed to be able to clearly see tapes 32, any deviations from the path designated would be interpreted as a deliberate attempt to flee the area instead of an unintentional error of a nervous but innocent driver. Tapes 32 provide a positive, clearly seen perimeter, the crossing of which triggers an advanced warning, therefore, of intended harm.

As in any military operation, fast and easy deployment is important.

Establishment of the PASZ station shown in FIG. 8 meets those requirements. Two suitcases 52, easily transported to the site, is sufficient to provide enough safety cones 10 to merge two lanes of traffic into a single lane along a highway, although more suitcases and cones can of course be employed. Safety cones 10 are easy to set up quickly by a limited number of relatively unskilled personnel. The specific types of modules needed for the anticipated situation are easily identified, selected, and attached to cones 10 either beforehand, on the way to the site, or after placement of the cones has been completed. Breaking the PASZ station down for transport to another location is likewise quick and easy.

The PASZ station shown in FIG. 8 can obviously be applied to civilian uses. The variability and interchangeability of the different types of modules, the collection and analyzation of the data, and the transmission of the data and results to a central home base give valuable assistance to civilian authorities, for example, to troopers manning a police roadblock or DUI checkpoint.

Figure 9:
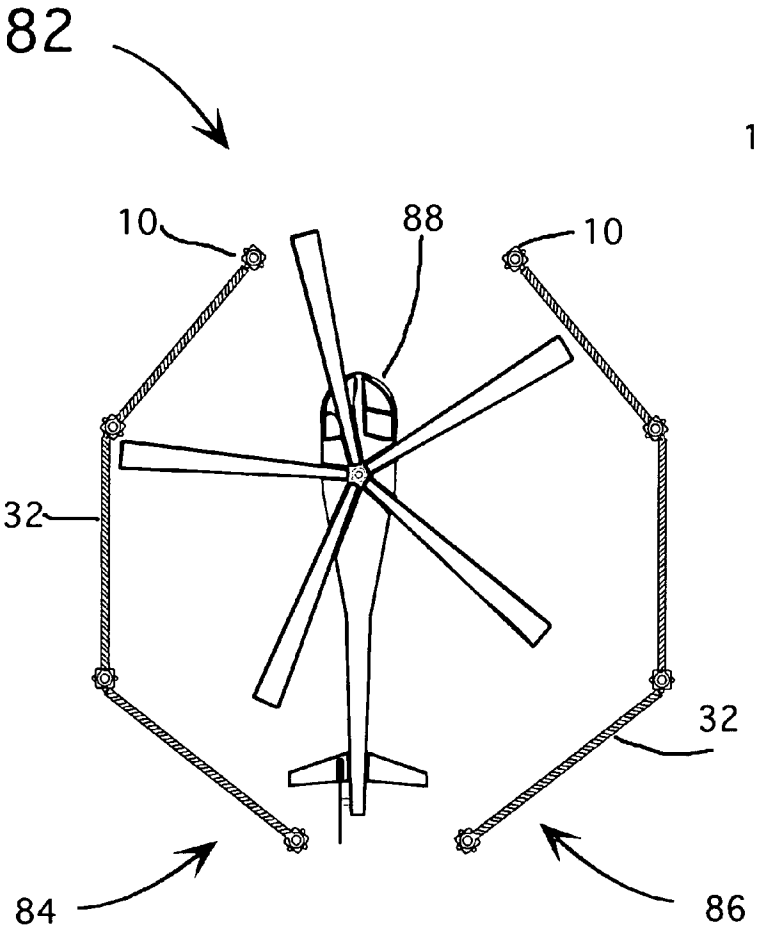
FIG. 9 shows a portable helipad created by proper placements of the safety cones of FIGS. 1-6.

Another important military application of the PASZ system is shown in FIG. 9.

Temporary helipads 82 are often needed when troops and/or supplies are deployed behind enemy lines. It is unreasonable to ask a helicopter pilot to select a suitable landing site when flying in unfamiliar territory, especially at night or during inclement weather. Selecting and delineating a site suitable as a temporary helipad is best left to a reconnaissance team on the ground.

Speed of deployment and safety for all concerned are prime considerations in creating and using a temporary helipad. From the reconnaissance team's point of view, speed and stealth minimizes the dangers of being discovered. The PASZ system, as has been seen, is capable of being quickly and easily set up and quickly and easily broken down. Two suitcases containing two sets of cones is all that is needed and are relatively easily transported to the scene.

Most prior art systems for setting up temporary helipads comprise a plurality of portable beacons, e.g., cones, lighted posts, etc., which are individually positioned by hand with no visible means interconnecting adjacent beacons. Such systems inherently present problems for ground and air personnel. The landing site is of necessity quite large, and the beacons are spaced apart often on uncompromising terrain by a person or persons who, being unable to see the arrangement of the beacons from above, cannot see if their placement clearly and unambiguously defines the landing area. The dangers are amplified when the construction is being done at night. The PASZ system connects the beacon cones with retro-reflective tapes. The overall configuration formed by the tapes are more easily seen by the reconnaissance team than an imaginary perimeter produced by the cones alone. This speeds up the layout of the temporary helipad, lowering the potential for danger to the reconnaissance team.

But the temporary helipad must also promote safety for the incoming pilots and accompanying personnel. An arrangement which looks good from the ground may not look as good from the air, especially when individual light beacons are positioned to simulate the oft-used Y-type landing strip. To one standing in the middle of the arrangement, its arrangement may appear close to perfect. From the air, at night, approaching the temporary helipad from changing directions and changing descent angles, the perceived pattern of the collection of lights changes continually, possibly confusing the pilot as to the location and orientation of the helipad. At times, the terrain will not permit perfect arrangements, even from ground personnel perspective; the resulting misarranged guides can be even more confusing to the incoming pilot, obviously creating extremely dangerous situations.

The PASZ combination of cones with retro-reflective tapes clarifies the helipad location, size, perimetrical configuration, and orientation for the helicopter pilot. The beacon modules on the cones guide the pilot to the general area, but unlike the pattern produced by unconnected individual cones which could be incomprehensible to the pilot, tapes 32 clearly and unambiguously mark the perimeter of the temporary helipad, day or night. Tapes 32 are brightly colored so as to be easily seen during the day. When making a night landing, incoming helicopters would, after being guided to the area by the beacons, typically scan the terrain with highly focused search beams, either with visual light or with infrared beams whose reflections are sensed electronically by infrared detectors or visually by night vision goggles. As mentioned earlier, tapes 32 are preferably of the retro-reflective type. Tapes 32, therefore, limit the reflections of the incoming highly focused search beams to highly focused beams reflected directly back to the pilot. The resulting visual image produced by connected tapes 32 clearly defines the landing zone of the helipad, removing all doubts as to the precise location of the landing point. The retro-reflective tapes 32 are passive in their emissions, so unwanted detection of the site is minimized, while the pilots ability to visualize the landing site's perimeter is enhanced.

Since the beacons used in locating the helipad site are not required to be the sole elements defining the outline of the landing site, they may be of the type which have relatively small outgoing signals. Their size, weight, and power requirements are consequently minimized, making them cheaper to manufacture, easier to store, and easier to transport. More importantly, the potential for detection by the enemy is reduced, thereby improving the safety margin for our troops.

Referring to FIG. 9, a temporary helipad can be created by the PASZ system with a minimum of sets of safety cones, just two suitcases. One set 84 of safety cones 10 are arrayed in a roughly C-shaped configuration opening in one direction. Another set 86 of safety cones 10 are arrayed in a similarly roughly C-shaped configuration which is opening in the opposite direction, facing set 84. The combination of arrangements of sets 84 and 86 of cones 10 are sufficient to define a generally circular perimeter for helipad 82. When possible, and subject to clear, unambiguous understandings between ground crew and pilots, the gaps between cones 10 at the top and bottom (as seen in FIG. 9) of helipad 82, where no tape 32 is present, could be informative, as well, indicating a suggested direction of descent and ascent or providing an indication of wind directions. Of course, this arrangement is merely illustrative, as more cones 10 could be employed, and the circular perimeter could be closed by connecting all tapes 32 to an adjacent cone 10.

The types of modules 44 selected for helipad 82 are chosen based on the function of guiding the helicopter pilot to helipad 82 and are affixed to bases 12 of cones 10. Beacons may be of any known type and design. Beacons that generate light, e.g., visible light from Xenon or halogen bulbs, invisible light from infrared or ultraviolet sources, such as LEDs, or coherent light from laser beams, are suitable. Beacons including homing signals comprising radio signals or GPS signals are preferred for guiding the pilot to the general site location. Any of the aforesaid beacons may be activated manually by the reconnaissance team or remotely by transceivers in modules 44 responding to signals from the incoming helicopters.

A landing helicopter 88 creates a tremendous down-draft which could blow one or more cones 10 out of position. PASZ cones 10 include several features which resist the down wash from helicopters. Base 12 is weighted, and retracting mechanism 30 is centrally located internally of base 12; both act as ballast which is usually enough for the stability of cone 10. The aerodynamically friendly shape of cones 10 resists ill effects from high winds, also. In the extended state (FIGS. 1 and 3) cones 10 have a tapered conical shape with circular cross-sections which inherently promotes smooth airflow therearound. Also, cones 10 are collapsible which reduces the height and consequently the total "sail" area exposed to the down-draft. If all else fails, anchoring stakes can be inserted through corner openings 38 and driven into the ground.

The helicopter down-draft could also lift tapes 32 sufficient to separate hitches 34 from the anchors 22 of their associated cones 10. Hitch pin 36 of hitch 34 at the free end of tape 32 preferably extends vertically upwardly, as shown in FIGS. 3 and 4, and can be linear or curved to form a hook. When placing hitch pin 36 upwardly through aperture 24, hitch 34 is beneath anchor tab 22. The weight of cone 10 bears down upon hitch 34, holding tape 32 flat against the ground. Tape 32 is preferably made of a material having a high tensile strength to resist forces tending to displace or rupture it.

Should the ground team be required to leave a temporary helipad 82 behind, because there is not enough time to remove the anchoring stakes, nothing which could be of real value to an enemy need be left. Modules 44, which are the only parts of a PASZ station which might include classified technology, are easily and quickly removable.

PASZ stations which create temporary helipads, as in FIG. 9, clearly have civilian applications as well. Fire and Rescue crews which respond to accidents, fires, or natural disasters would find it useful to carry one or more suitcases 52. For example, lane closures of the type shown in FIG. 8 cordoning off accident scenes can be quickly and easily effected using PASZ technology. For serious accidents requiring helicopter rescues, a PASZ station helipad, such as shown in FIG. 9, will guide pilots to safe landing sites and away from dangerous obstacles which may not be easy for them to see from the air, such as power lines. Rescues from mountainous areas, where flat surfaces might be difficult to identify from the air, can be facilitated by the PASZ system. PASZ's portability permits ground crews to carry them through rough terrain to find the optimum location for setting up a PASZ helipad.

Figure 10:
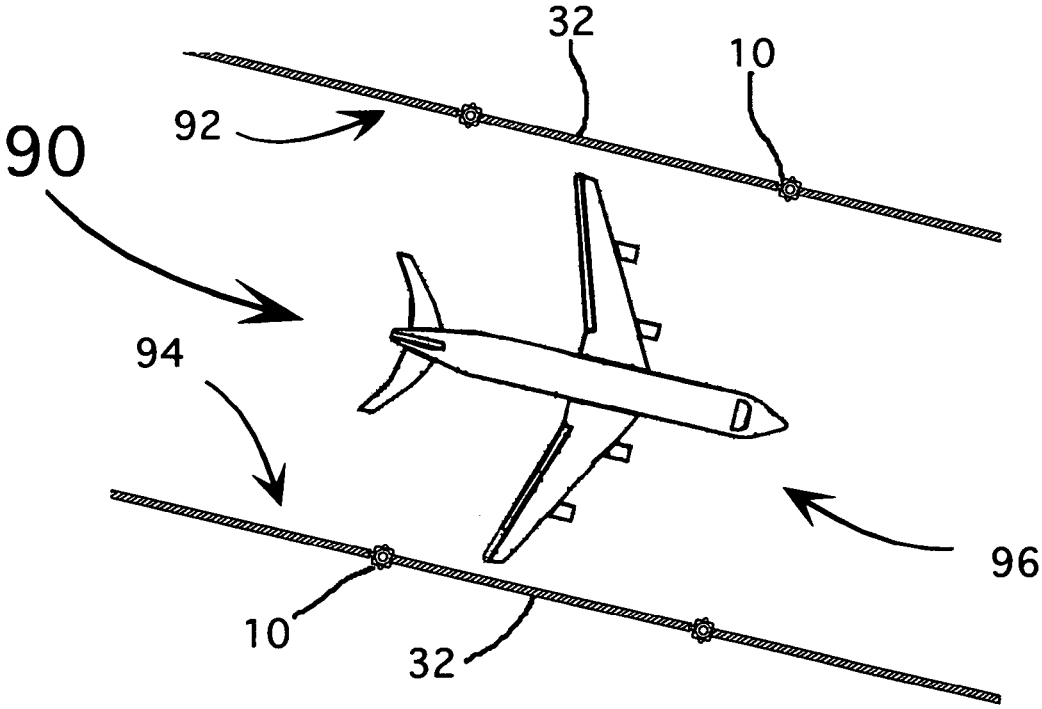
FIG. 10 shows a portable landing strip created by the safety cones of FIGS. 1-6.

Temporary runways 90 for larger aircraft, as shown in FIG. 10, are quickly and easily outlined by the PASZ system. A set 92 of safety cones 10 are linearly aligned and joined together by attaching retro-reflective tape 32 to the adjacent cone. A similar set 94 is located parallel to set 92 and spaced apart sufficiently to accommodate the largest airplane 96 anticipated to land there. Beacon modules 44 would guide the pilots to the runway, and the brightly colored, retro-reflective tapes 32 would show quite clearly the edges thereof.

Establishing temporary runways for military aircraft in hostile surroundings, such as in open deserts, is clearly important, but other applications in other venues are within PASZ's capabilities. Delineating a segment of an open highway, for example, which has been cleared for an emergency landing is accomplished quickly and easily with the PASZ system. PASZ permits the quick and easy establishment and identification of a specific commercial runway for emergency use. When the runway designated for an incoming airplane must suddenly be closed because of an accident, pilots of approaching aircraft can be clearly and unambiguously directed to an alternate runway by swift deployment of a PASZ runway 90. The speed permitted by PASZ systems in establishing such an alternate runway can, of course, be crucial in achieving a safe landing.

There are innumerable circumstances in which an area must be cordoned off for security or safety reasons. Easily recognizable examples include police crime scenes, highway work zones, Hollywood celebrity functions, rock concert entry ways, and many, many more. The common factor in each is that restricting the area is localized both in time and in place; they are to be cordoned off in a specific place for a specified period of time, and then to be restored to their original unrestricted status. The PASZ system is ideal for establishing temporary perimeters. Two such examples are shown in FIGS. 11 and 12.

Figure 11:
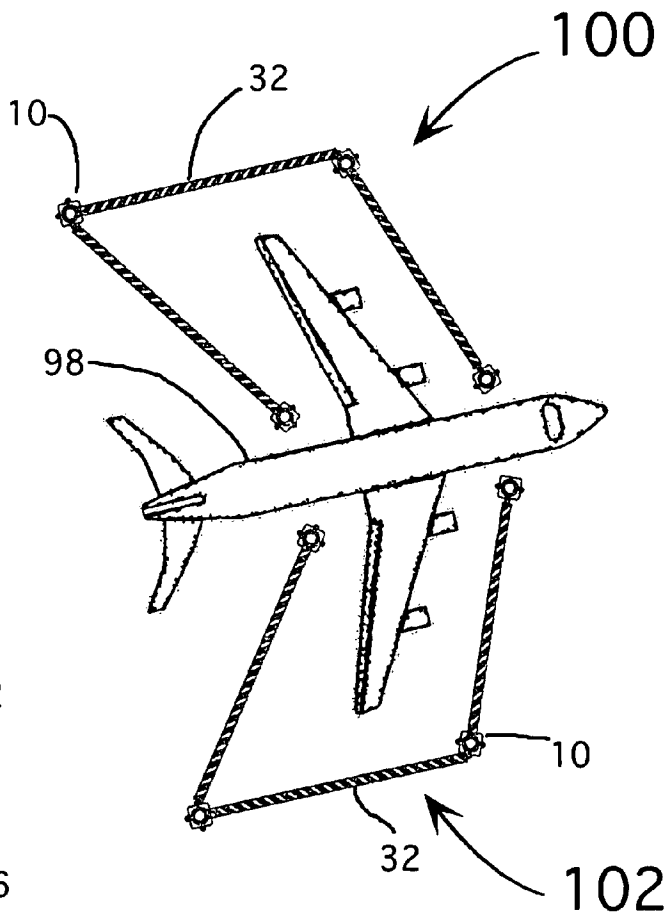
FIG. 11 shows the safety cones of FIGS. 1-6 cordoning off the area around a parked airplane.

In FIG. 11, a safety zone is established around the wings of an aircraft 98 by two sets 100 and 102 of cones. Retro-reflective, retractable tapes 32 are capable of being extended outside of cones 10 to various lengths, from zero feet (unextended) to a minimum of fifteen feet each, thereby allowing the PASZ system to adapt to any size or shape work area. By lying flat on the ground, tapes 32 also allow work vehicles to enter and leave the PASZ stations. For example, if the luggage on board the aircraft 98 is being off-loaded, baggage carts can be brought within feet of the cargo bays without disturbing the cones 10 or tapes 32. If mechanical work is being performed on the aircraft, repair vehicles can approach as close as is needed while still being off-limits to nonessential personnel. When the job is finished, the PASZ stations are returned to their suitcases 52 (not shown in FIG. 11) for transporting to the next job site or for storage.

Figure 12:
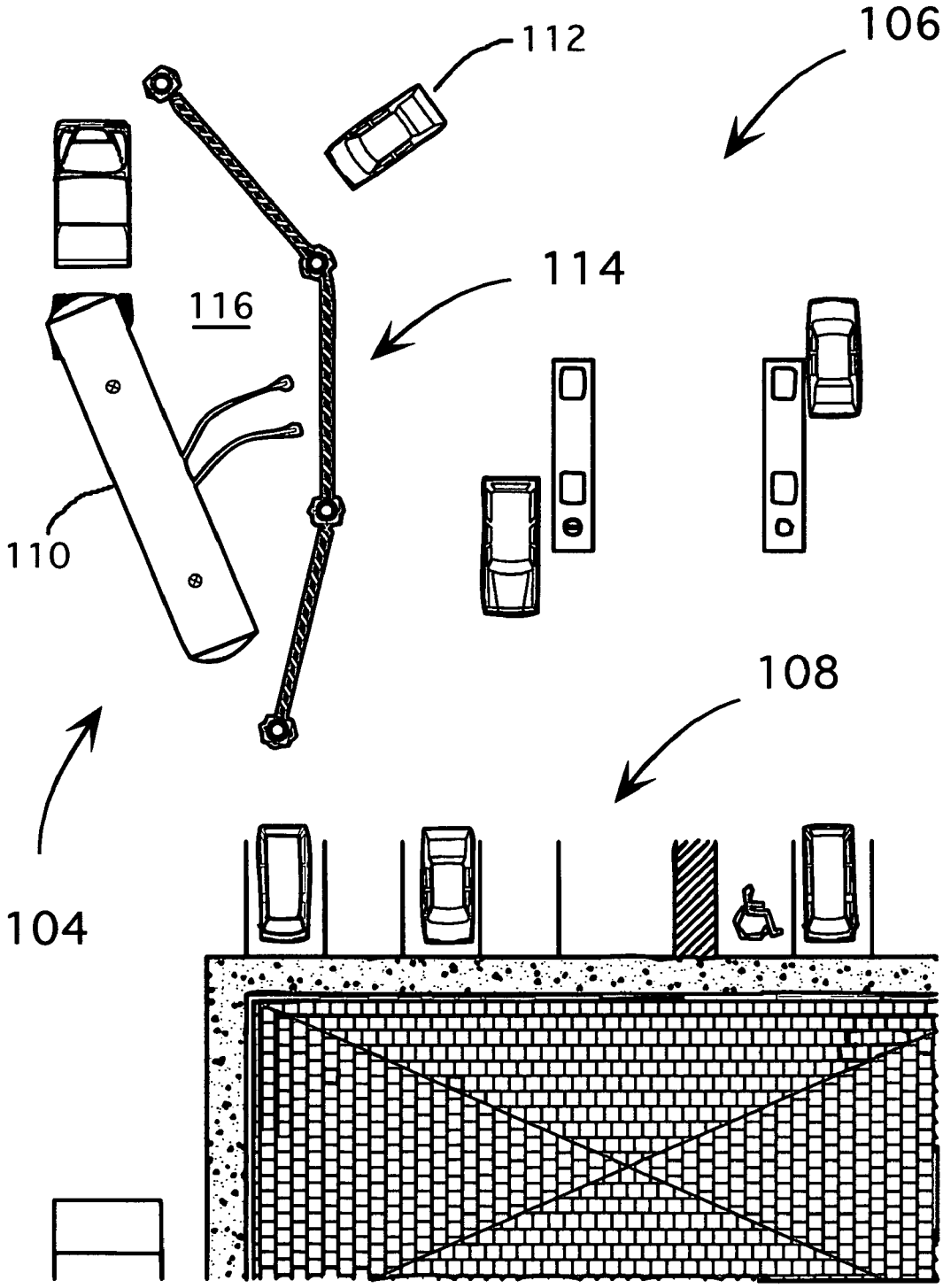
FIG. 12 shows the safety cones of FIGS. 1-6 cordoning off the area around a parked gasoline tanker truck at a commercial service station.

When neighborhood service stations 104 receive a shipment of gasoline, as shown in FIG. 12, the facility does not close to the public during the delivery. Dispensing gasoline at the pumps 106 and shopping at the station's mini-mart 108 continues unabated. This activity can expose the scene to potential danger, e.g., from a carelessly thrown cigarette butt near the fumes emanating from gasoline tanker truck 110 or from a driver not giving sufficient attention to controlling his vehicle 112. The bright colors and reflective qualities of the PASZ station 114 clearly alerts the public to stay away from the delivery area 116. Modules 44 are selected appropriately to further warn passersby to stay clear of delivery area 116. Motion sensors which activate flashing lights, beeping horns, moving mechanical structures, such as a waving flag, an oscillating or rotating arm, etc., and a PA system on truck 110 to play recorded messages, are among the modules 44 available to warn patrons and workers of unwanted intrusions into the delivery area.

From the preceding, it is clear that the PASZ system has numerous useful applications, from protecting our troops in war to protecting ordinary citizens in everyday activities. The diversity of uses is due to the integration of a wide variety of modules and the PASZ safety cone into a novel system for establishing PASZ stations. The entire system is easily portable due to cones 10 being collapsible such that they can be stored in suitcases 52 and transported with minimum difficulty to and from the selected PASZ site. Permanently enclosing the retracting mechanism 30 within its cone 10 simplifies the combination and facilitates its handling. The ability to selectively attach one or more modules 44 having specific functions enlarges the number and types of environments within which the PASZ system is uniquely effective. And, transforming from one type of PASZ system to one of the many other varieties of PASZ systems is effected quickly and easily by ordinary people without the need for extensive training in highly technical subjects.

CLAIMS

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the foregoing Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is it intended to be limiting as to the scope of the invention in any way.

It is to be understood that the disclosure is by way of illustration only and that the scope of the invention is to be limited solely by the following claims:

I claim:

1. A safety icon for a portable area safety zoning system, said safety icon comprising:

an upright body and a base, said base including at least one anchor tab integral therewith; and a retractable tape assembly, said tape assembly comprising a retracting mechanism and a tape, said retracting mechanism being mounted on said base within the body of said safety icon, and said tape having one end operatively connected to said retracting mechanism and a second free end, a hitch attached to said second free end, said tape extending through a slot in said base, and said hitch being adapted to releasably connect with one of said anchor tabs on an adjacent safety icon.

2. A safety icon for a portable area safety zoning system as in claim 1, wherein said tape is brightly colored and retro-reflective.

3. A safety icon for a portable area safety zoning system as in claim 1, wherein said safety icon is in the form of a traffic cone.

4. A safety icon for a portable area safety zoning system as in claim 3, wherein said cone is collapsible.

5. A safety icon for a portable area safety zoning system as in claim 4, wherein said collapsible cone comprises a plurality of segments interconnected by locking mechanisms which lock said cone segments alternately in an extended state and in a collapsed state.

6. A safety icon for a portable area safety zoning system as in claim 1, wherein said tape lies flat on the ground between said safety icons when said hitch is releasably connected to one of said anchor tabs on an adjacent safety icon.

7. A portable area safety zoning system, comprising:

a plurality of safety icons, each of said safety icons comprising:

an upright body and a base, said base including at least one anchor tab integral therewith;

a retractable tape assembly, said tape assembly comprising a retracting mechanism and a tape, said tape including a first end operably attached to said retracting mechanism, a second free end, and a hitch connected to said second free end; and said retracting mechanism being mounted on said base within the body of said safety icon and said tape extending through a slot in said base;

a plurality of modules, each of said modules being designed to perform a particular task;

said base including a plurality of mounts for receiving a like plurality of said modules;

at least one module being releasably attached to at least one of said plurality of said mounts; and a set of safety icons, said set comprising a plurality of said safety icons, at least one set of said safety icons being arranged to define the perimeter of a safety zone, each safety icon being connected to at least one adjacent safety icon by at least one of said tapes being extended from its base and the hitch of said at least one of said tapes being releasably attached to an anchor tab on an adjacent safety icon.

8. A portable area safety zoning system as in claim 7, wherein said safety zone comprises a surveillance station wherein one set of said safety icons is arranged to form a fence directing traffic into a single lane, and another set of said safety icons is arranged to border the opposite side of said single lane, wherein suspect vehicles comprising said traffic are channeled into said single lane in order to be closely observed.

9. A portable area safety zoning system as in claim 8, wherein said surveillance station further comprises a plurality of modules attached to selected mounts of selected bases of said safety icons of each set of safety icons, at least one of said plurality of modules being a video camera module and the remaining of said plurality of modules comprising selected modules from the group comprising explosive detecting modules, chemical detecting modules, radiation sensing modules, motion sensor modules, accelerometer modules, and audio receiving modules.

10. A portable area safety zoning system as in claim 9, wherein selected ones of said modules include transceivers for receiving and sending signals.

11. A portable area safety zoning system as in claim 10, wherein said surveillance station further comprises a local central control station comprising a mobile transportation vehicle, at least one transceiver operatively interacting with said plurality of modules, and a portable computer, said portable computer displaying the results of the data provided by said plurality of modules and controlling said plurality of modules.

12. A portable area safety zoning system as in claim 11, wherein said surveillance station further comprises at least one video camera system mounted on a tripod including a video camera being directed at said suspect vehicles, and said central control station further comprising facial recognition software, vehicle license plate software, and related databases.

13. A portable area safety zoning system as in claim 12, wherein said tripod mounted video camera system further comprises automatic voice language translation capability.

14. A portable area safety zoning system as in claim 7, wherein said safety zone comprises a temporary, portable landing site, comprising:

two sets of safety icons, one set arranged to form one side of said landing site and the other set arranged to form the other side of said landing site;

said tapes having at least one brightly colored, retro-reflective surface; and said modules being selected from the group comprising beacon modules comprising the group of visible light emitters, invisible light emitters, coherent light emitters, radio signal emitters, and GPS signal emitters.

15. A portable area safety zoning system as in claim 14, wherein said temporary, portable landing site further comprises a temporary landing strip for fixed winged aircraft, wherein said one set is linearly aligned on one side of a landing area and said other set is linearly aligned substantially parallel to said one set on the other side of a landing area, and said tapes of each set forming a substantially straight line defining a visual edge to said temporary landing strip.

16. A portable area safety zoning system as in claim 14, wherein said temporary, portable landing site further comprises a temporary helicopter landing pad, wherein said one set is arranged as an open "C" on one side of a landing area with said "C" facing in one direction and said other set is arranged as an open "C" on the other side of said landing area, said "C" of said other set facing in the opposite direction, so that said C-shaped arrangements face each other to define a roughly circular perimeter.

17. A portable area safety zoning system as in claim 7, wherein said safety zone comprises a restricted area cordoned off by at least one set of safety icons comprising a plurality of temporary, portable safety icons, said plurality of said temporary, portable safety icons of said at least one set of safety icons being arranged to define an irregular perimeter conforming to the size and shape needed for said restricted area;

said tapes have at least one brightly colored, retro-reflective surface, and said tapes lie flat on the ground between said safety icons;

a plurality of modules releasably attached to said safety icons, said plurality of modules being selected from the group comprising motion sensor modules, speed sensing modules, accelerometer modules, and audio receiving modules; and said modules activating an alarm upon sensing an actual or potential intruder into said restricted area.

18. A portable area safety zoning system as in claim 17, wherein said alarm comprises at least one from the group comprising flashing lights, audible beeping horns, moving mechanical structures, and a recorded message played on a PA system.

19. A safety icon for a portable area safety zoning system, said safety icon comprising:

an upright body and a base, said base including at least one anchor tab integral therewith;

a retractable tape assembly, said tape assembly comprising a retracting mechanism and a tape, said retracting mechanism being mounted on said base within the body of said safety icon, and said tape having one end operatively connected to said retracting mechanism and a second free end, a hitch attached to said second free end, said tape extending through a slot in said base, and said hitch being adapted to releasably connect with one of said anchor tabs on an adjacent safety icon;

a plurality of modules, each of said modules being designed to perform a particular task;

said base including a plurality of mounts for receiving a like plurality of said modules; and at least one module being releasably attached to at least one of said plurality of said mounts.

20. The safety icon for a portable area safety zoning system as in claim 19 wherein said tape has at least one brightly colored, retro-reflective surface, and said modules are selected from the group comprising motion sensor modules, speed sensing modules, accelerometer modules, audio receiving modules, and beacon modules comprising the group of visible light emitters, invisible light emitters, coherent light emitters, radio signal emitters, and GPS signal emitters.

* * * * *